US010254024B2

(12) United States Patent
Higashiiue et al.

(10) Patent No.: US 10,254,024 B2
(45) Date of Patent: Apr. 9, 2019

(54) DISTRIBUTOR AND REFRIGERATION CYCLE APPARATUS

(71) Applicant: Mitsubishi Electric Corporation, Tokyo (JP)

(72) Inventors: Shinya Higashiiue, Tokyo (JP); Shigeyoshi Matsui, Tokyo (JP); Akira Ishibashi, Tokyo (JP); Daisuke Ito, Tokyo (JP); Yuki Ugajin, Tokyo (JP); Takumi Nishiyama, Tokyo (JP); Shin Nakamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 126 days.

(21) Appl. No.: 15/512,170

(22) PCT Filed: Jan. 16, 2015

(86) PCT No.: PCT/JP2015/051070
§ 371 (c)(1),
(2) Date: Mar. 17, 2017

(87) PCT Pub. No.: WO2016/113901
PCT Pub. Date: Jul. 21, 2016

(65) Prior Publication Data

US 2017/0276414 A1 Sep. 28, 2017

(51) Int. Cl.

| | |
|---|---|
| ***F25B 41/06*** | (2006.01) |
| ***F25B 13/00*** | (2006.01) |
| ***F25B 39/02*** | (2006.01) |

(52) U.S. Cl.
CPC ..... *F25B 41/06* (2013.01); *F25B 13/00* (2013.01); *F25B 39/028* (2013.01); *F25B 41/067* (2013.01)

(58) Field of Classification Search
CPC ..... F25B 39/028; F25B 2500/12; F25B 2500/13; F25B 41/06; F25B 41/067; F25B 2341/062; F25B 2500/01; F25B 2500/17
See application file for complete search history.

(56) References Cited

U.S. PATENT DOCUMENTS 3,642,030 A * 2/1972 Amick ..... F16L 55/027 138/44
3,864,938 A * 2/1975 Hayes, Jr. ..... F25B 41/06 137/14

(Continued)

FOREIGN PATENT DOCUMENTS

| | | |
|---|---|---|
| JP | 2001-116396 A | 4/2001 |
| JP | 2003-214727 A | 7/2003 |
| JP | 2010-169315 A | 8/2010 |

OTHER PUBLICATIONS

Office Action dated Aug. 1, 2017 issued in corresponding JP patent application No. 2016-569196 (and English translation).

(Continued)

*Primary Examiner* — Cassey D Bauer
(74) *Attorney, Agent, or Firm* — Posz Law Group, PLC

(57) ABSTRACT

A distributor includes a main body. The main body includes a refrigerant inflow path, a plurality of refrigerant outflow paths, a distribution path communicating with the refrigerant inflow path and the plurality of refrigerant outflow paths, and a plurality of tapered paths each communicating between corresponding one of the plurality of refrigerant outflow paths and the distribution path. The tapered paths each have an inlet opening and an outlet opening, the inlet opening being larger than the outlet opening.

15 Claims, 9 Drawing Sheets

(56) References Cited

U.S. PATENT DOCUMENTS

| | | | | |
|---|---|---|---|---|
| 6,864,938 | B2 * | 3/2005 | Kaneko | G02F 1/133305 349/138 |
| 2015/0000332 | A1 * | 1/2015 | Michitsuji | F25B 41/00 62/525 |

OTHER PUBLICATIONS

International Search Report of the International Searching Authority dated Apr. 14, 2015 for the corresponding international application No. PCT/JP2015/051070 (and English translation).
Extended European Search Report dated Aug. 17, 2018 issued in corresponding EP patent application No. 15877853.0.
Office action dated Dec. 5, 2018 issued in corresponding CN patent application No. 201580064977.2 (and English translation thereof).

* cited by examiner

DISTRIBUTOR AND REFRIGERATION CYCLE APPARATUS

CROSS REFERENCE TO RELATED APPLICATION

This application is a U.S. national stage application of International Application No. PCT/JP2015/051070, filed on Jan. 16, 2015, the contents of which are incorporated herein by reference.

TECHNICAL FIELD

The present invention relates to a distributor that distributes refrigerant, and a refrigeration cycle apparatus including the distributor.

BACKGROUND ART

A refrigeration cycle apparatus that utilizes a steam compressor includes the compressor, a condenser, an expansion valve, and an evaporator. In a typical refrigeration cycle apparatus, indoor or outdoor air is utilized as heat source for a heat exchanger that acts as condenser and evaporator. The heat exchanger includes a plurality of paths to reduce flow loss of the refrigerant.

Conventionally, a distributor is connected to the plurality of paths of the heat exchanger via capillary tubes (Patent Literature 1).

PATENT LITERATURE

Patent Literature 1: Japanese Unexamined Patent Application Publication No. 2010-169315 (paragraphs [0037] to [0041])

When the heat exchanger acts as evaporator, two-phase refrigerant depressurized in the expansion valve flows into the heat exchanger, and hence it is necessary to evenly distribute the liquid-phase component and the gas-phase component to each of the paths of the heat exchanger, to thereby prevent degradation in performance of the heat exchanger. In the case where the distributor and the capillary tubes disclosed in Patent Literature 1 are used when the heat exchanger acts as evaporator, a vortex is generated because the refrigerant flow paths are drastically narrowed at the entrance of the capillary tubes, and therefore a dead water region is created in the vicinity of the entrance of the capillary tubes. In the dead water region created as above, sludge generated in the refrigeration cycle is prone to be deposited, and may clog the capillary tubes when the refrigeration cycle apparatus is operated for a long time. In particular, a mixed refrigerant containing HFO1123 and HFO1123, which have low global warming potential, is chemically instable and prone to be decomposed in the refrigeration cycle, to be thereby coupled with other substances thus generating the sludge. When the capillary tubes are clogged, the distributor becomes unable to evenly distribute the two-phase refrigerant to the evaporator, which leads to degraded reliability of the refrigeration cycle apparatus.

SUMMARY

The present invention has been accomplished in view of the foregoing problem, and provides a distributor and a refrigeration cycle apparatus configured to suppress generation of the vortex and prevent clogging of the capillary tubes.

In one embodiment, the present invention provides a distributor including a main body including a refrigerant inflow path, a plurality of refrigerant outflow paths, a distribution path communicating with the refrigerant inflow path and the plurality of refrigerant outflow paths, and a plurality of tapered paths each communicating between corresponding one of the plurality of refrigerant outflow paths and the distribution path. The plurality of tapered paths each have an inlet opening and an outlet opening, the inlet opening being larger than the outlet opening.

In another embodiment, the present invention provides a refrigeration cycle apparatus including a compressor, a condenser, an expansion valve, the aforementioned distributor, and an evaporator.

The distributor of one embodiment of the present invention includes the tapered path provided between each of the refrigerant outflow paths and the distribution path, and hence the refrigerant flow path is not drastically narrowed in the refrigerant outflow paths. Therefore, the distributor configured as above suppresses generation of a vortex in the refrigerant outflow paths. In addition, a dead water region can be reduced, and therefore deposition of sludge in the refrigerant outflow path can be prevented.

DETAILED DESCRIPTION

Embodiment 1

Figure 1:
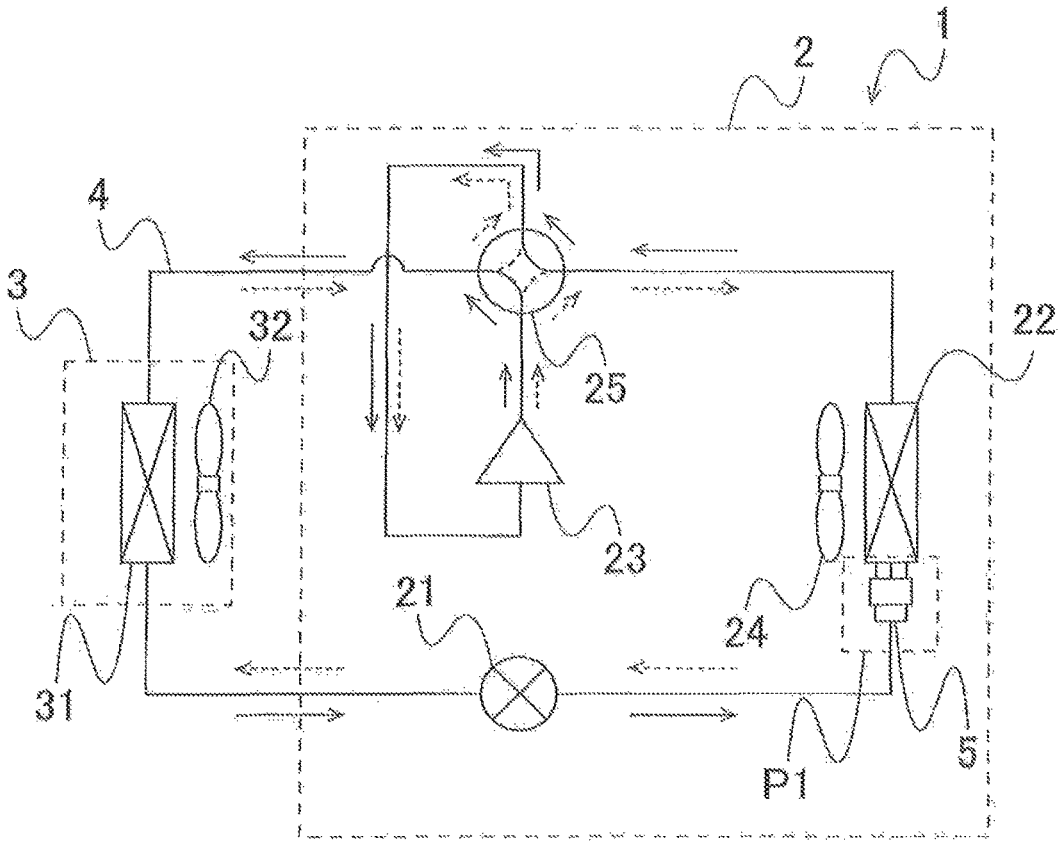
FIG. 1 is a schematic diagram showing a configuration of an air-conditioning apparatus 1 according to Embodiment 1 of the present invention.

An air-conditioning apparatus 1 according to Embodiment 1 of the present invention will be described hereunder. FIG. 1 is a schematic diagram showing a configuration of the air-conditioning apparatus 1 according to Embodiment 1 of the present invention. In FIG. 1 and other drawings, dimensional relationships between components and shapes thereof may differ from actual ones.

The air-conditioning apparatus 1 according to Embodiment 1 includes an outdoor unit 2 and an indoor unit 3. The outdoor unit 2 includes therein an expansion valve 21, an outdoor heat exchanger 22, and a compressor 23. The indoor unit 3 includes therein an indoor heat exchanger 31. The expansion valve 21, the outdoor heat exchanger 22, the compressor 23, and the indoor heat exchanger 31 constitute a refrigeration cycle 4 in which refrigerant circulates.

In Embodiment 1, refrigerant having low global warming potential, such as HFO1123, may be employed as refrigerant circulating in the refrigeration cycle 4. Such refrigerant may be employed in the form of a single refrigerant, or a mixed refrigerant containing two or more types of refrigerants.

The expansion valve 21 serves to depressurize high-pressure refrigerant into low-pressure refrigerant. The expansion valve 21 may be, for example, constituted of an electronic expansion valve of which the opening degree is regulated. The outdoor heat exchanger 22 acts as evaporator in a heating operation, and acts as condenser in a cooling operation. The compressor 23 is a fluid machine that compresses low-pressure refrigerant sucked thereinto and discharges the compressed refrigerant in the form of high-pressure refrigerant. The indoor heat exchanger 31 acts as condenser in a heating operation, and acts as evaporator in a cooling operation. In Embodiment 1, the outdoor heat exchanger 22 and the indoor heat exchanger 31 each include a plurality of paths, to reduce flow loss of the refrigerant. Here, the cooling operation refers to an operation for supplying low-temperature and low-pressure refrigerant to the indoor heat exchanger 31, and the heating operation refers to an operation for supplying high-temperature and high-pressure refrigerant to the indoor heat exchanger 31.

When the outdoor unit 2 includes an outdoor unit fan 24, the outdoor heat exchanger 22 exchanges heat between the refrigerant flowing therein and air (outdoor air) supplied (sent) from the outdoor unit fan 24. The outdoor unit fan 24 is located so as to oppose the outdoor heat exchanger 22, to supply the outdoor air to the outdoor heat exchanger 22. The outdoor unit fan 24 may be, for example, constituted of a propeller fan that generates, upon rotating, airflow that passes through the outdoor heat exchanger 22.

In the case where the air-conditioning apparatus 1 is configured to perform the heating operation and the cooling operation, the outdoor unit 2 includes a refrigerant flow switching device 25 for switching the flow direction of the refrigerant in the refrigeration cycle 4. The refrigerant flow switching device 25 may be, for example, constituted of a four-way valve.

When the indoor unit 3 includes an indoor unit fan 32, the indoor heat exchanger 31 exchanges heat between the refrigerant flowing therein and air (indoor air) supplied (sent) from the indoor unit fan 32. The indoor unit fan 32 may be constituted of a centrifugal fan (e.g., sirocco fan, turbo fan), a cross-flow fan, a mixed flow fan, an axial flow fan (e.g., propeller fan) or the like. When one of such fans rotates, airflow that passes through the indoor heat exchanger 31 is generated.

In Embodiment 1, the outdoor unit 2 includes a distributor 5 provided between the expansion valve 21 and the outdoor heat exchanger 22. The configuration of the distributor 5 according to Embodiment 1 will be subsequently described.

Hereunder, the working of the refrigeration cycle 4 of the air-conditioning apparatus 1 in the heating operation will be described. In FIG. 1, solid-line arrows indicate the refrigerant flow direction in the heating operation. In the heating operation the refrigerant flow path is switched by the refrigerant flow switching device 25 as indicated solid lines, so that the refrigeration cycle 4 is constituted so as to cause low-temperature and low-pressure two-phase refrigerant to flow to the outdoor heat exchanger 22.

High-temperature and high-pressure gas-phase refrigerant discharged from the compressor 23 flows into the indoor heat exchanger 31 through the refrigerant flow switching device 25. In the heating operation, the indoor heat exchanger 31 acts as condenser. The indoor heat exchanger 31 exchanges heat between the refrigerant flowing therein and the air (indoor air) sent from the indoor unit fan 32, so that the condensation heat of the refrigerant is radiated to the sent air. Accordingly, the high-temperature and high-pressure gas-phase refrigerant which has entered the indoor heat exchanger 31 turns into two-phase refrigerant, and then into high-pressure liquid-phase refrigerant. The high-pressure liquid-phase refrigerant flows into the expansion valve 21 to be depressurized therein, thus turning into low-pressure two-phase refrigerant, and flows into the outdoor heat exchanger 22 through the distributor 5. In the heating operation, the outdoor heat exchanger 22 acts as evaporator. The outdoor heat exchanger 22 exchanges heat between the refrigerant flowing therein and the air (outdoor air) sent from the outdoor unit fan 24, so that the evaporation heat of the refrigerant is removed from the sent air. Accordingly, the low-pressure two-phase refrigerant which has entered the outdoor heat exchanger 22 turns into low-pressure gas-phase refrigerant, or low-pressure two-phase refrigerant having high quality. The low-pressure gas-phase refrigerant, or the low-pressure two-phase refrigerant having high quality is sucked into the compressor 23 through the refrigerant flow switching device 25. The low-pressure gas-phase refrigerant sucked into the compressor 23 is compressed, thereby turning into the high-temperature and high-pressure gas-phase refrigerant. During the heating operation, the mentioned cycles are repeated in the refrigeration cycle 4.

Hereunder, the working of the refrigeration cycle 4 of the air-conditioning apparatus 1 in the cooling operation will be described. In FIG. 1, broken-line arrows indicate the refrigerant flow direction in the cooling operation. In the cooling operation the refrigerant flow path is switched by the refrigerant flow switching device 25 as indicated broken lines, so that the refrigeration cycle 4 is constituted so as to cause low-temperature and low-pressure two-phase refrigerant to flow into the indoor heat exchanger 31. In the cooling operation, the refrigerant flows in the opposite direction to that of the heating operation, and the indoor heat exchanger 31 acts as evaporator. In the cooling operation, the indoor heat exchanger 31 exchanges heat between the refrigerant flowing therein and the air (indoor air) sent from the indoor unit fan 32, so that the evaporation heat of the refrigerant is received to the sent air.

The configuration of the distributor 5 according to Embodiment 1 will now be described hereunder. The following description is based on the assumption that the refrigeration cycle 4 of the air-conditioning apparatus 1 performs the heating operation. The terms "upstream" and "downstream" are used with reference to the flow direction of the refrigerant in the heating operation.

Figure 2:
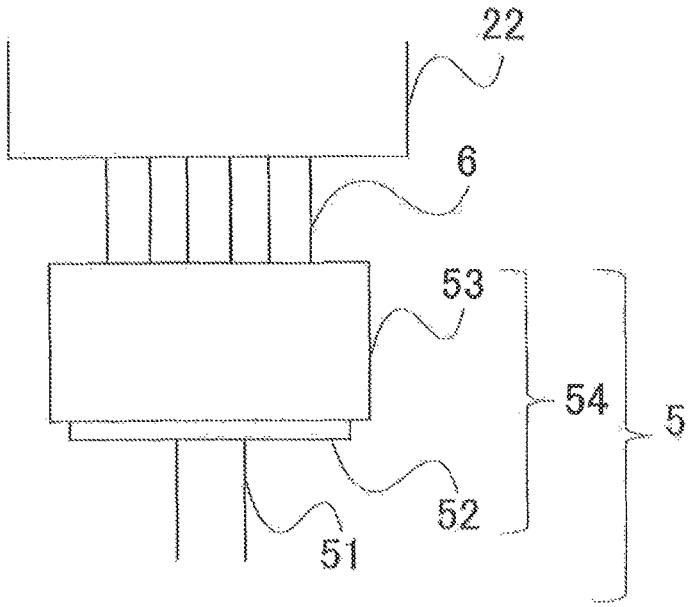
FIG. 2 is an enlarged schematic drawing showing a connection state of a distributor 5 in the air-conditioning apparatus 1 according to Embodiment 1 of the present invention.

FIG. 2 is an enlarged schematic drawing showing a connection state of the distributor 5 in the air-conditioning apparatus 1 according to Embodiment 1 of the present invention. FIG. 2 corresponds to a region surrounded by broken lines denoted as P1 in FIG. 1.

In Embodiment 1, a main body 54 of the distributor 5 includes a first member 52 and a second member 53. An introduction pipe 51 is connected to the expansion valve 21 via a refrigerant pipe. In Embodiment 1, the introduction pipe 51 is connected to the first member 52. A plurality of capillary tubes 6 are connected to the second member 53.

Figure 3A:
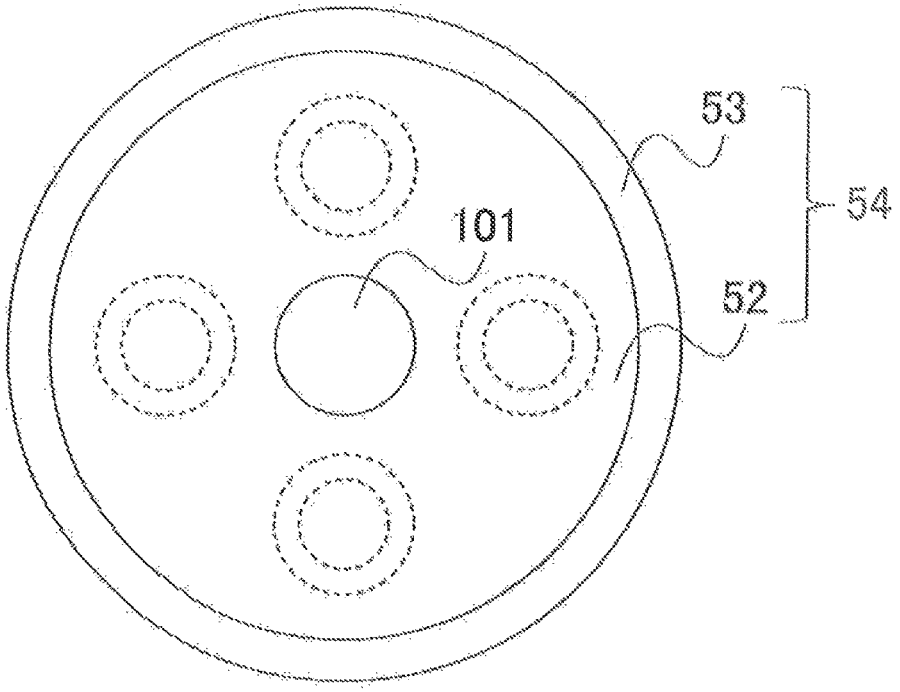
FIG. 3*a* is a schematic plan view of the distributor 5 according to Embodiment 1 of the present invention, seen from an upstream side.
Figure 3B:
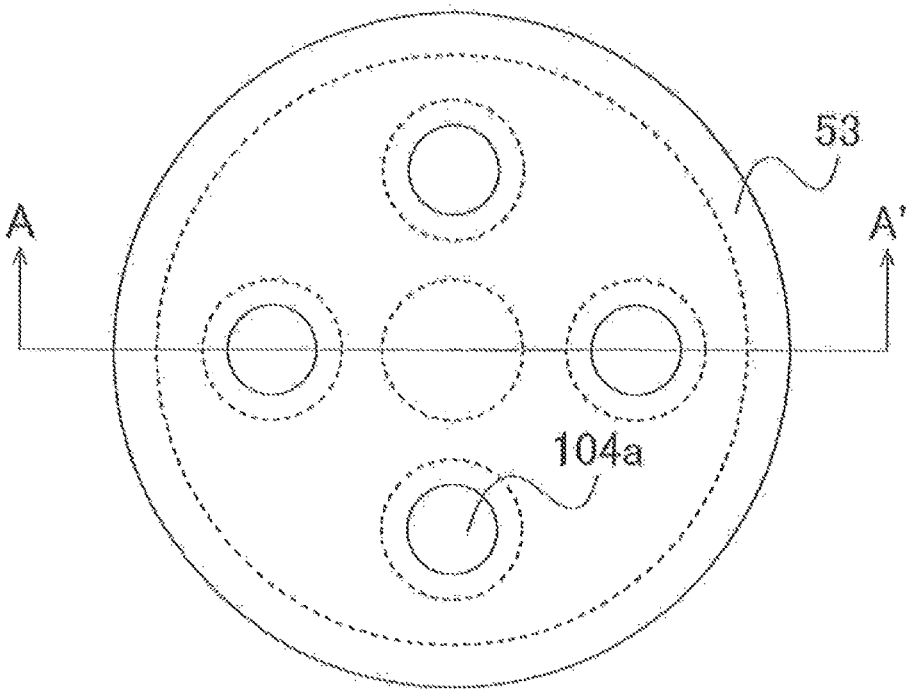
FIG. 3*b* is a schematic plan view of the distributor 5 according to Embodiment 1 of the present invention, seen from a downstream side.
Figure 3C:
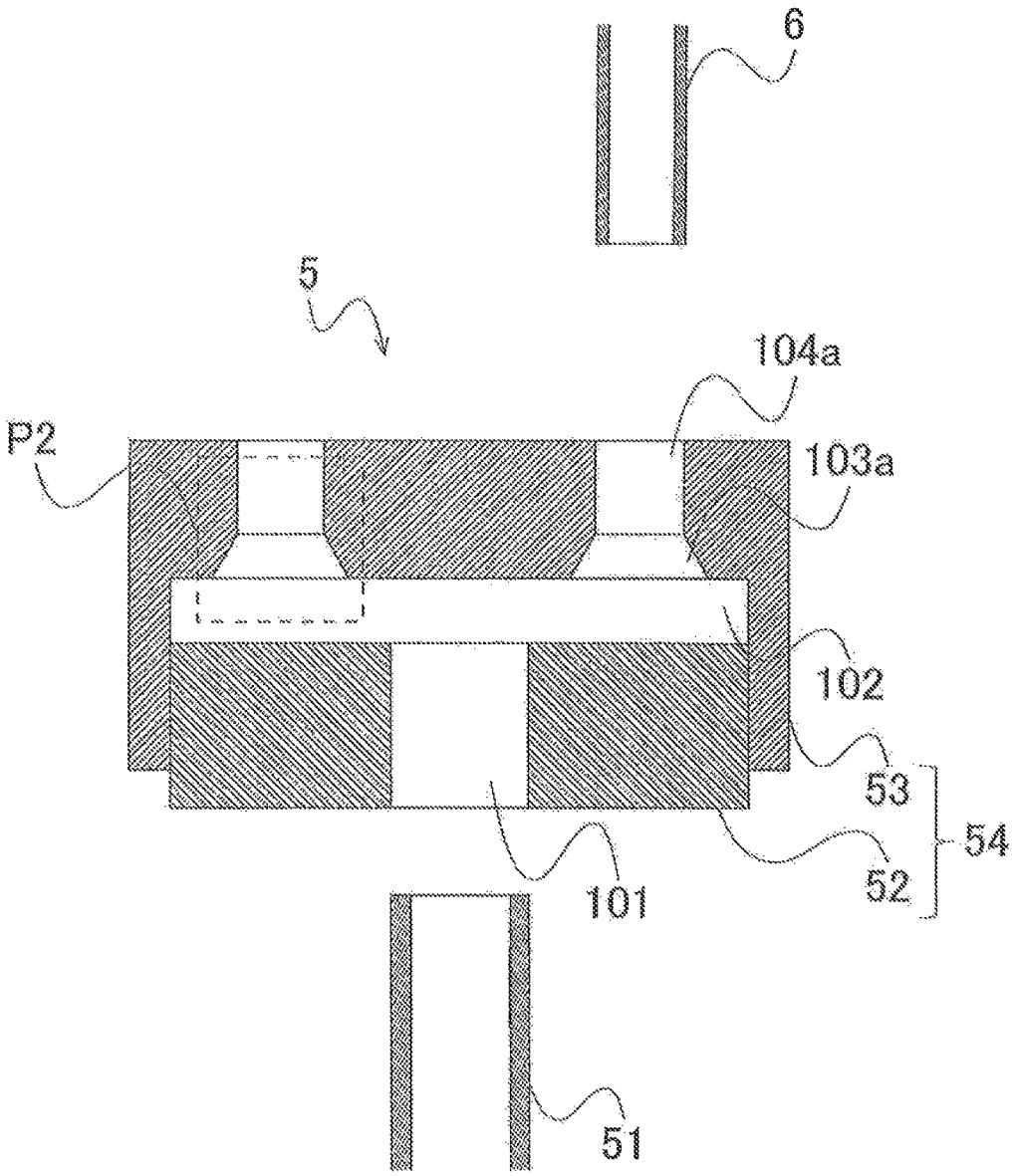
FIG. 3*c* is a schematic cross-sectional view showing the distributor 5 according to Embodiment 1 of the present invention.

FIG. 3*a* is a schematic plan view of the distributor 5 according to Embodiment 1 of the present invention, seen from the upstream side. FIG. 3*b* is a schematic plan view of the distributor 5 according to Embodiment 1 of the present invention, seen from the downstream side. FIG. 3*c* is a schematic cross-sectional view showing the distributor 5 according to Embodiment 1 of the present invention. FIG. 3*c* corresponds to a cross-section taken along a line A-A' in the plan view of FIG. 3*b*.

The first member 52 has a hollow cylindrical shape including a refrigerant inflow path 101. The second member 53 has an inner surface of a cylindrical shape in which the outer circumferential surface of the first member 52 can be fitted. In Embodiment 1, the second member 53 has an outer circumferential surface of a cylindrical shape. The first member 52 and the second member 53 are coupled to each other, for example by brazing, so as to define a distribution path 102 communicating with the refrigerant inflow path 101, between one of hollow disk-shaped surfaces of the first member 52 and the inner surface of the second member 53. In Embodiment 1, the introduction pipe 51 is connected to the refrigerant inflow path 101, for example by brazing. The distribution path 102 constitutes a cylindrical flow path in Embodiment 1.

The second member 53 includes a plurality of refrigerant outflow paths 104*a*. In Embodiment 1, the second member 53 includes four refrigerant outflow paths 104*a*. In Embodiment 1, the capillary tubes 6 are each connected to corresponding one of the refrigerant outflow paths 104*a*, so as to form a capillary tube joint portion. The capillary tubes 6 are respectively connected to the refrigerant outflow paths 104*a*, for example by brazing.

The second member 53 includes a plurality of tapered paths 103*a* each communicating between the corresponding one of the refrigerant outflow paths 104*a* and the distribution path 102. The plurality of tapered paths 103*a* each include an inlet opening and an outlet opening, the inlet opening being larger than the outlet opening. In Embodiment 1, the tapered paths 103*a* communicate with the distribution path 102 on the opposite side of the refrigerant inflow path 101. In Embodiment 1, four tapered paths 103*a* having a truncated conical shape are provided.

The working of the distributor 5 according to Embodiment 1 will be described hereunder.

The low-pressure two-phase refrigerant which has flowed out of the expansion valve 21 flows into the distribution path 102 through the introduction pipe 51. The two-phase refrigerant which has entered the distribution path 102 is divided therein and branched to the plurality (four in Embodiment 1) of tapered paths 103*a*. The two-phase refrigerant branched as above flows into the outdoor heat exchanger 22 (evaporator) through the capillary tubes 6 respectively connected to the refrigerant outflow paths 104*a*.

Embodiment 1 provides the following advantageous effects.

Figure 4A:
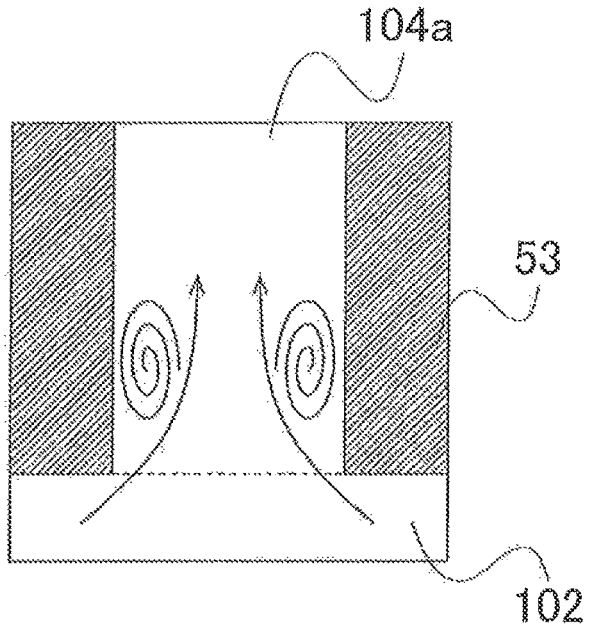
FIG. 4*a* is a schematic drawing showing a flow of refrigerant in a refrigerant outflow path of a conventional distributor.

FIG. 4*a* is a schematic drawing showing a flow of refrigerant in a refrigerant outflow path of a conventional distributor. FIG. 4*a* is only intended for comparison with the effects of the distributor 5 according to Embodiment 1, and hence the components in FIG. 4*a* are given the same numeral as those of Embodiment 1. Further, the capillary tube is excluded from FIG. 4*a* in order to clearly illustrate the flow of the refrigerant.

In the conventional distributor, the refrigerant flow path is drastically narrowed at the refrigerant outflow path, and therefore a vortex is generated at the entrance of the refrigerant outflow path, when the refrigerant flows thereinto. The vortex creates a region where the flow speed is extremely slow in the refrigerant outflow path, and such a region constitutes a dead water region. When the air-conditioning apparatus 1 is operated for a long time, sludge generated in the refrigeration cycle is prone to be deposited in the dead water region in the refrigerant outflow path, so as to clog the capillary tube. When the capillary tube is clogged, the distributor becomes unable to evenly distribute the two-phase refrigerant to the evaporator, which leads to degraded reliability of the refrigeration cycle apparatus.

In Embodiment 1, in contrast, the presence of the tapered path 103*a* between the refrigerant outflow path 104*a* and the distribution path 102 suppresses the generation of the vortex at the entrance of the refrigerant outflow path 104*a*. Further description will be given with reference to FIG. 4*b*.

Figure 4B:
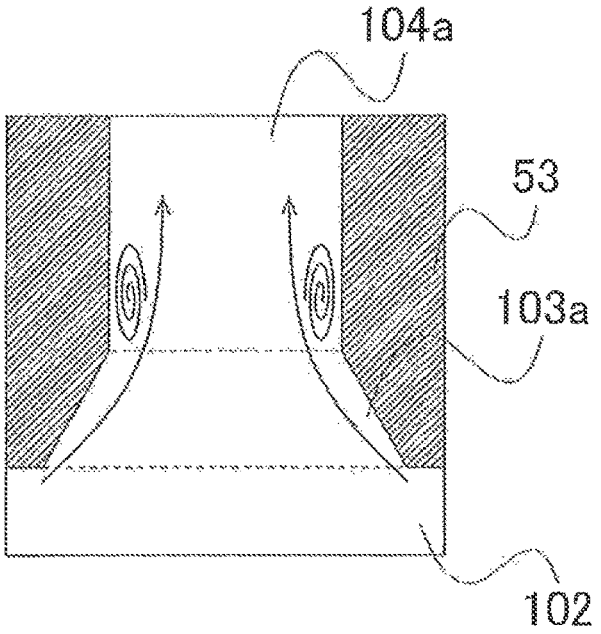
FIG. 4*b* is a schematic drawing showing a flow of refrigerant in a refrigerant outflow path 104*a* in the distributor 5 according to Embodiment 1 of the present invention.

FIG. 4*b* is a schematic drawing showing the flow of the refrigerant in the refrigerant outflow path 104*a* of the distributor 5 according to Embodiment 1 of the present invention. FIG. 4*b* corresponds to a region surrounded by broken lines denoted as P2 in FIG. 3*c*. The capillary tube 6 is excluded from FIG. 4*b*, in order to clearly illustrate the flow of the refrigerant.

Since the distributor 5 according to Embodiment 1 includes the tapered path 103*a* between each of the refrigerant outflow paths 104*a* and the distribution path 102, the refrigerant flow path is not narrowed drastically at the refrigerant outflow path 104*a*. Therefore, the distributor 5 according to Embodiment 1 suppresses the generation of the vortex in the refrigerant outflow path 104*a*. In the distributor 5 according to Embodiment 1, the generation of the dead water region can be suppressed by suppressing the generation of the vortex, and therefore the sludge can be prevented from being deposited in the refrigerant outflow path 104*a*, which leads to prevention of the clogging of the capillary tube 6. The distributor 5 according to Embodiment 1 is, consequently, capable of evenly distributing the two-phase refrigerant to each path of the outdoor heat exchanger 22

(evaporator), despite the air-conditioning apparatus 1 having been in operation for a long time. As result, the distributor 5 according to Embodiment 1 can be used for an extended period of time, which leads to improved reliability and durability of the air-conditioning apparatus 1.

Embodiment 2

Figure 5A:
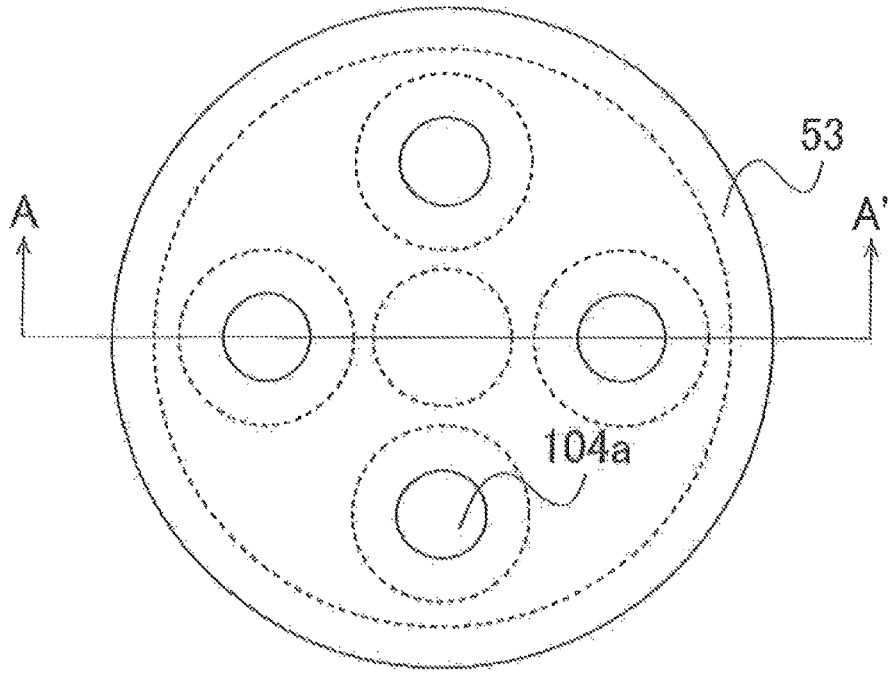
FIG. 5*a* is a schematic plan view of the distributor 5 according to Embodiment 2 of the present invention, seen from the downstream side.
Figure 5B:
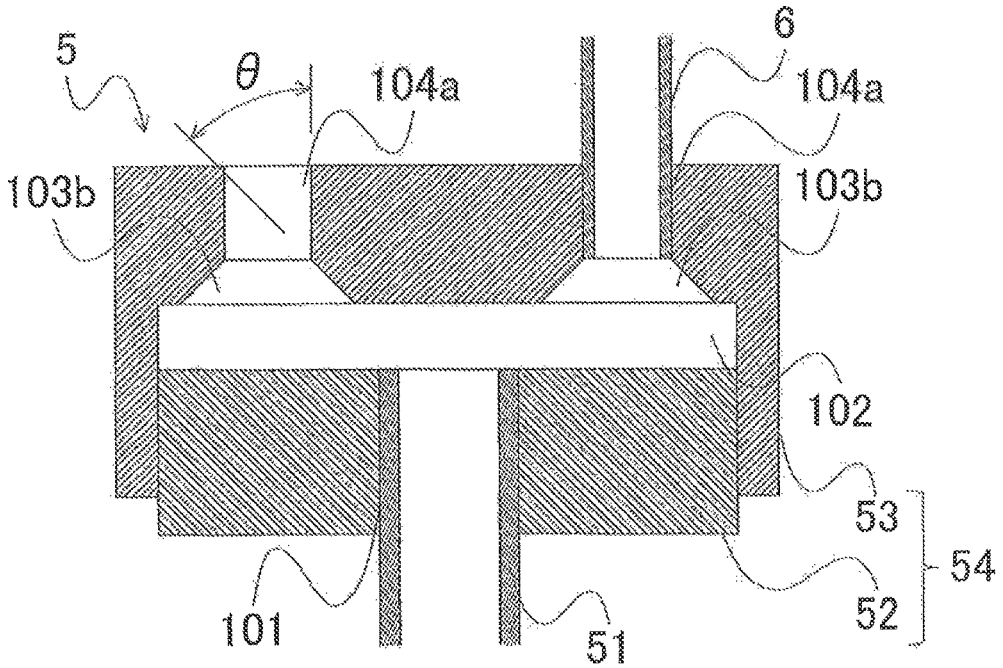
FIG. 5*b* is a schematic cross-sectional view showing the distributor 5 according to Embodiment 2 of the present invention.

FIG. 5*a* is a schematic plan view of the distributor 5 according to Embodiment 2 of the present invention, seen from the downstream side. FIG. 5*b* is a schematic cross-sectional view showing the distributor 5 according to Embodiment 2 of the present invention. FIG. 5*b* corresponds to a cross-section taken along a line A-A' in the plan view of FIG. 5*a*.

In Embodiment 2, the tapered path 103*b* having a truncated conical shape is formed such that an angle θ between the generatrix thereof and the flow direction is between 30 degrees and 60 degrees. The other components are configured in the same way as in Embodiment 1, and hence the description will not be repeated.

When the angle θ is less than 30 degrees, the refrigerant flow path is drastically narrowed at the tapered path 103*b*, and therefore the generation of the vortex is unable to be suppressed on the side of the inlet opening of the tapered path 103*b*. Conversely, when the angle θ is larger than 60 degrees, the generation of the vortex can be suppressed on the side of the inlet opening of the tapered path 103*b*. However, the refrigerant flow path is drastically narrowed at the refrigerant outflow path 104*a*, and therefore the generation of the vortex is unable to be suppressed at the entrance of the refrigerant outflow path 104*a*.

In Embodiment 2, setting the angle θ to be equal to or more than 30 degrees and equal to or less than 60 degrees suppresses the generation of the vortex at the inlet opening of the tapered path 103*b* and the entrance of the refrigerant outflow path 104*a*. The distributor 5 according to Embodiment 2 is, therefore, capable of evenly distributing the two-phase refrigerant to each path of the outdoor heat exchanger 22 (evaporator), despite the air-conditioning apparatus 1 having been in operation for a long time. Consequently, the distributor 5 according to Embodiment 2 can be used for an extended period of time, which leads to improved reliability and durability of the air-conditioning apparatus 1.

Embodiment 3

Figure 6A:
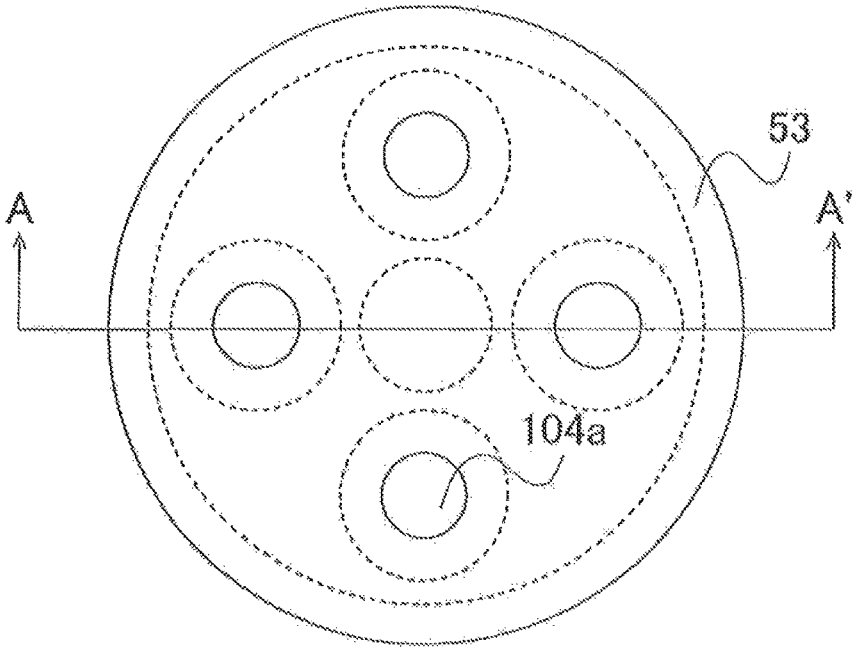
FIG. 6*a* is a schematic plan view of the distributor 5 according to Embodiment 3 of the present invention, seen from the downstream side.
Figure 6B:
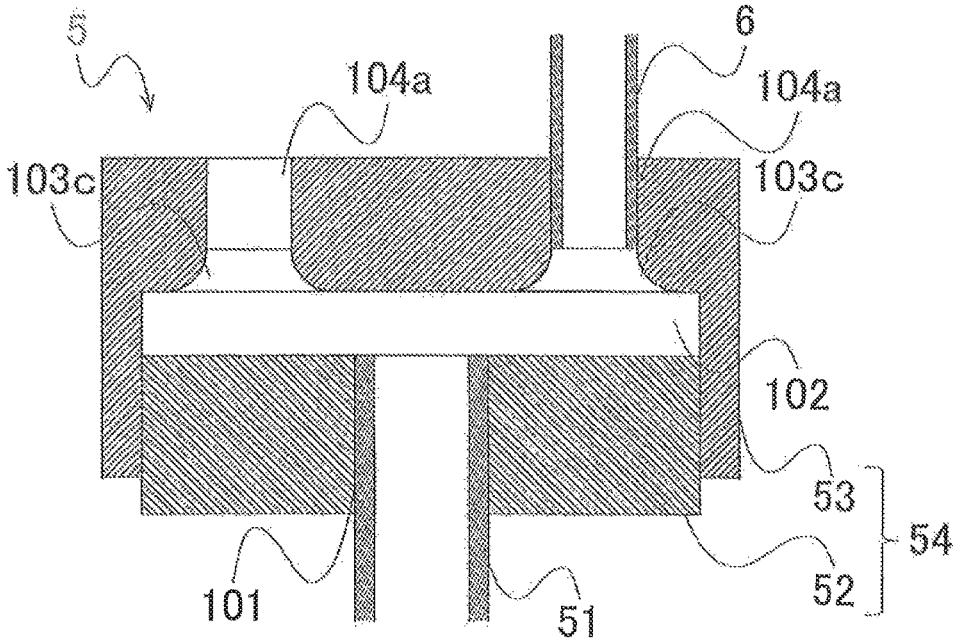
FIG. 6*b* is a schematic cross-sectional view showing the distributor 5 according to Embodiment 3 of the present invention.

FIG. 6*a* is a schematic plan view of the distributor 5 according to Embodiment 3 of the present invention, seen from the downstream side. FIG. 6*b* is a schematic cross-sectional view showing the distributor 5 according to Embodiment 3 of the present invention. FIG. 6*b* corresponds to a cross-section taken along a line A-A' in the plan view of FIG. 6*a*.

In Embodiment 3, the tapered path 103*c* is formed such that a cross-sectional shape taken along the flow path direction has a quadrant shape. The other components are configured in the same way as in Embodiment 1, and hence the description will not be repeated.

In Embodiment 3, forming the cross-sectional shape of the tapered path 103*c* taken along the flow path direction in the quadrant shape prevents the flow of the two-phase refrigerant from drastically changing at the inlet opening of the tapered path 103*c* and the entrance of the refrigerant outflow path 104*a*, thereby suppressing the generation of the vortex. The distributor 5 according to Embodiment 3 is, therefore, capable of evenly distributing the two-phase refrigerant to each path of the outdoor heat exchanger 22 (evaporator), despite the air-conditioning apparatus 1 having been in operation for a long time. Consequently, the distributor 5 according to Embodiment 3 can be used for an extended period of time, which leads to improved reliability and durability of the air-conditioning apparatus 1.

Embodiment 4

Figure 7A:
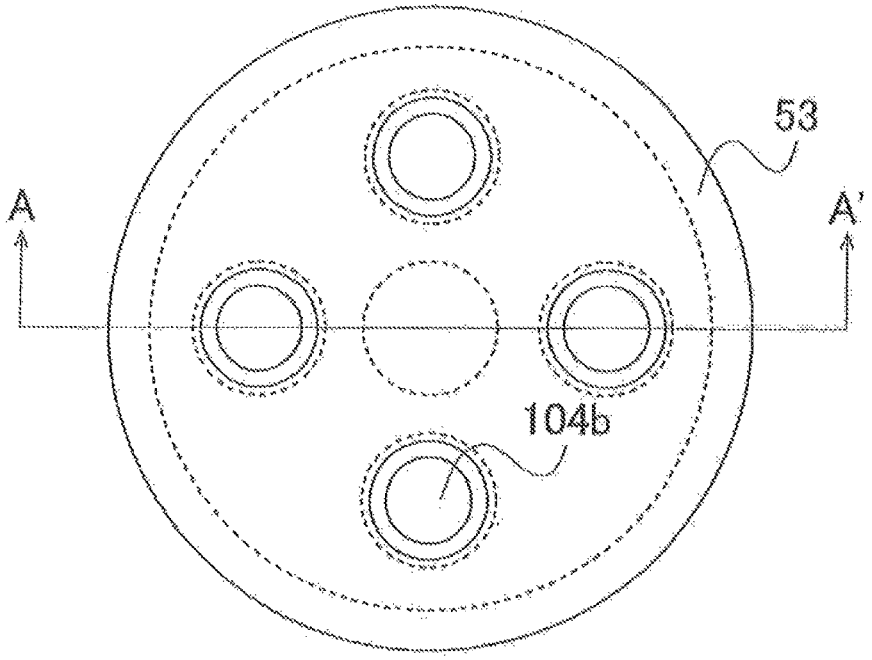
FIG. 7*a* is a schematic plan view of the distributor 5 according to Embodiment 4 of the present invention, seen from the downstream side.
Figure 7B:
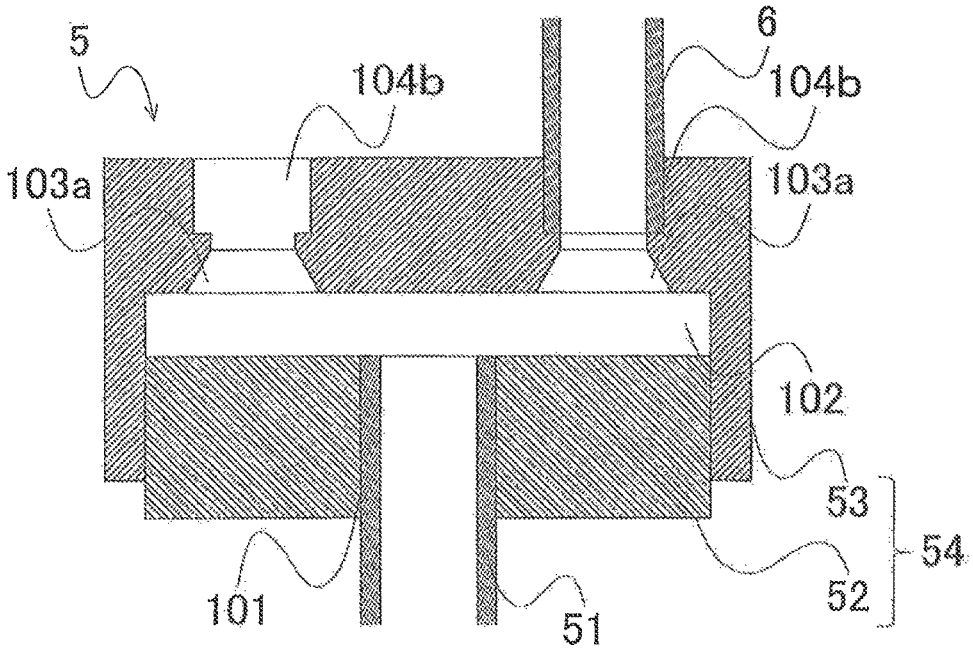
FIG. 7*b* is a schematic cross-sectional view showing the distributor 5 according to Embodiment 4 of the present invention.

FIG. 7*a* is a schematic plan view of the distributor 5 according to Embodiment 4 of the present invention, seen from the downstream side. FIG. 7*b* is a schematic cross-sectional view showing the distributor 5 according to Embodiment 4 of the present invention. FIG. 7*b* corresponds to a cross-section taken along a line A-A' in the plan view of FIG. 7*a*.

In the distributor 5 according to Embodiment 4, the inner diameter of the capillary tube 6 connected to the refrigerant outflow path 104*b* is the same as the diameter of the outlet opening of the tapered path 103*a*. In Embodiment 4, the refrigerant outflow path 104*b* includes a stepped portion, formed such that the diameter of the upper edge thereof is the same as the outer diameter of the capillary tube 6, and that the diameter of the lower edge of the stepped portion is the same as the inner diameter of the capillary tube 6 and the diameter of the outlet opening of the tapered path 103*a*. The other components are configured in the same way as in Embodiment 1, and hence the description will not be repeated.

In Embodiment 4, making the inner diameter of the capillary tube 6 the same as the diameter of the outlet opening of the tapered path 103*a* reduces the change of the flow of the two-phase refrigerant at the entrance of the capillary tube 6, thereby suppressing the generation of the vortex. The distributor 5 according to Embodiment 4 is, therefore, evenly distributes the two-phase refrigerant to each path of the outdoor heat exchanger 22 (evaporator), despite the air-conditioning apparatus 1 having been in operation for a long time. Consequently, the distributor 5 according to Embodiment 4 can be used for an extended period of time, which leads to improved reliability and durability of the air-conditioning apparatus 1.

Embodiment 5

Figure 8:
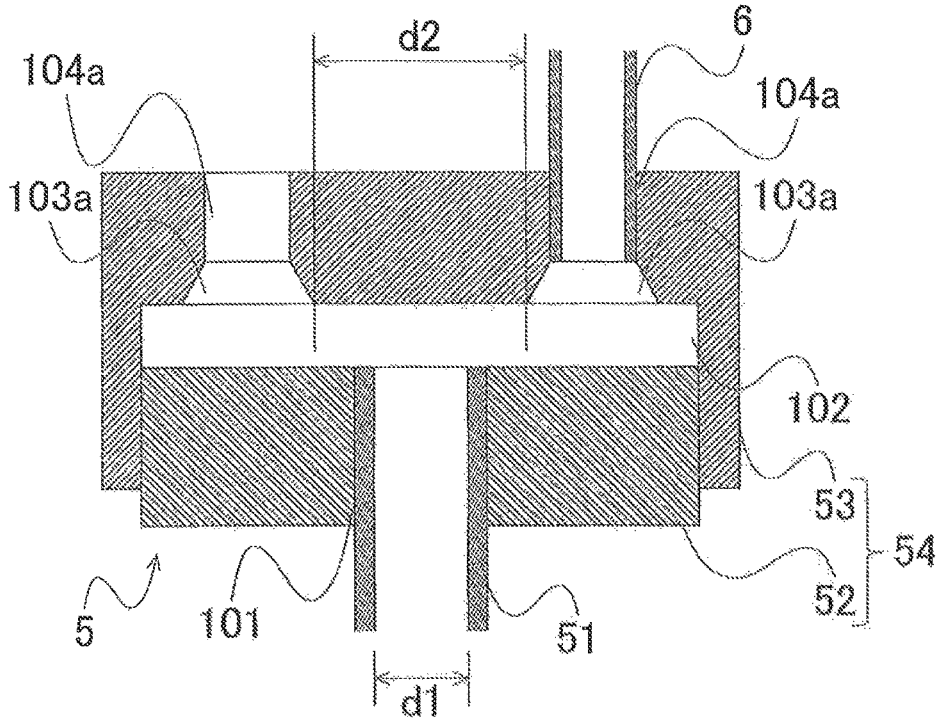
FIG. 8 is a schematic cross-sectional view showing the distributor 5 according to Embodiment 5 of the present invention.

FIG. 8 is a schematic cross-sectional view showing the distributor 5 according to Embodiment 5 of the present invention. In FIG. 8, the introduction pipe 51 is connected to the refrigerant inflow path 101 of the first member 52, and the capillary tubes 6 are respectively connected to the refrigerant outflow paths 104*a* of the second member 53. In addition, dimension lines are included in FIG. 8. FIG. 8 represents the same configuration as FIG. 3*c*, except for the presence of the dimension lines.

Since the components of Embodiment 5 are the same as those in Embodiment 1, the description will not be repeated. In Embodiment 5, the plurality of tapered paths 103*a* are each formed so as to receive the two-phase refrigerant, after the two-phase refrigerant flowing out of the introduction pipe 51 collides a wall surface of the distribution path 102 opposing the introduction pipe 51. In other words, the refrigerant inflow path 101 is formed so as to allow the refrigerant to evenly flow into each of the tapered paths 103*a* through the distribution path 102. In Embodiment 5, the outlet of the introduction pipe 51 having an inner diameter d1 is located inside a circumscribed circle having a diameter d2 drawn so as to contact the inlet opening of all the tapered paths 103*a*.

In Embodiment 5, the two-phase refrigerant flowing in through the introduction pipe 51 collides the opposing wall surface and is dispersed, and the dispersed refrigerant evenly branches to the plurality of tapered paths 103*a*. In other words, in Embodiment 5 the refrigerant can be prevented from directly flowing into the tapered path 103*a* from the introduction pipe 51. Since the two-phase refrigerant does not directly flow into the tapered paths 103*a* in Embodiment 5, the split flows of the two-phase refrigerant can be prevented from becoming uneven, despite the two-phase refrigerant flowing in an uneven state (for example, liquid-phase component is biased) from the introduction pipe 51. In Embodiment 5, therefore, the two-phase refrigerant can be evenly distributed to each path of the outdoor heat exchanger 22 (evaporator), and consequently the expected performance of the outdoor heat exchanger 22 (evaporator) can be secured even though the two-phase refrigerant flowing through the introduction pipe 51 is uneven.

Embodiment 6

Figure 9:
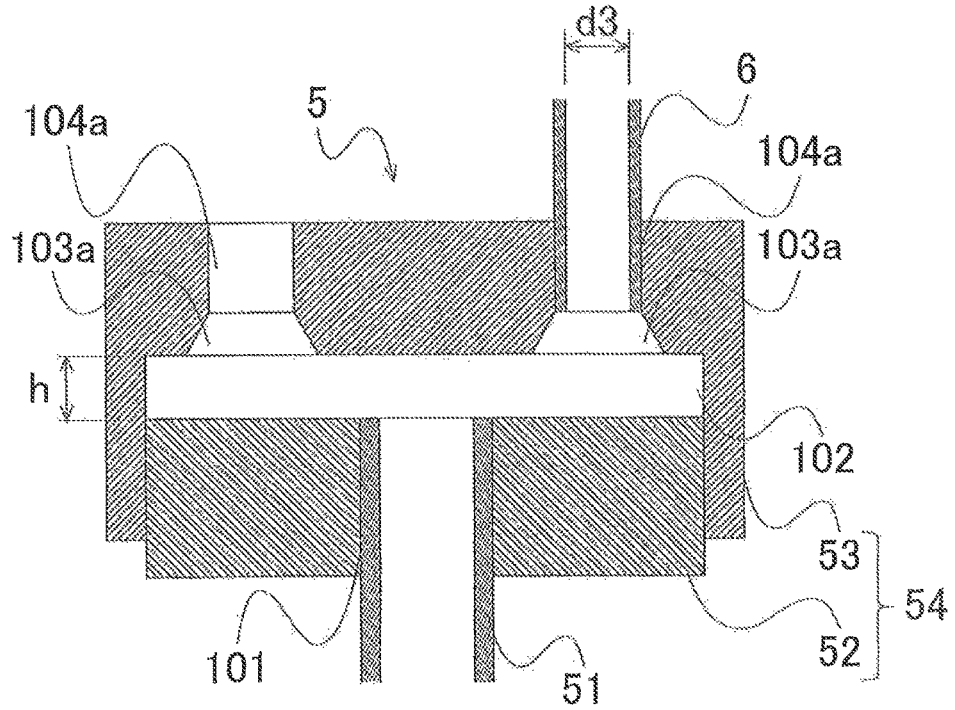
FIG. 9 is a schematic cross-sectional view showing the distributor 5 according to Embodiment 6 of the present invention.

FIG. 9 is a schematic cross-sectional view showing the distributor 5 according to Embodiment 6 of the present invention. In FIG. 9, the introduction pipe 51 is connected to the refrigerant inflow path 101 of the first member 52, and the capillary tubes 6 are respectively connected to the refrigerant outflow paths 104*a* of the second member 53. In addition, dimension lines are included in FIG. 9. FIG. 9 represents the same configuration as FIG. 3*c*, except for the presence of the dimension lines.

Since the components of Embodiment 6 are the same as those in Embodiment 1, the description will not be repeated. In the distributor 5 according to Embodiment 6, a ratio of a width h of the distribution path 102 in the flow direction to an inner diameter d3 of the capillary tube 6 is set to be higher than 0.5 and lower than 1.5.

Figure 10:
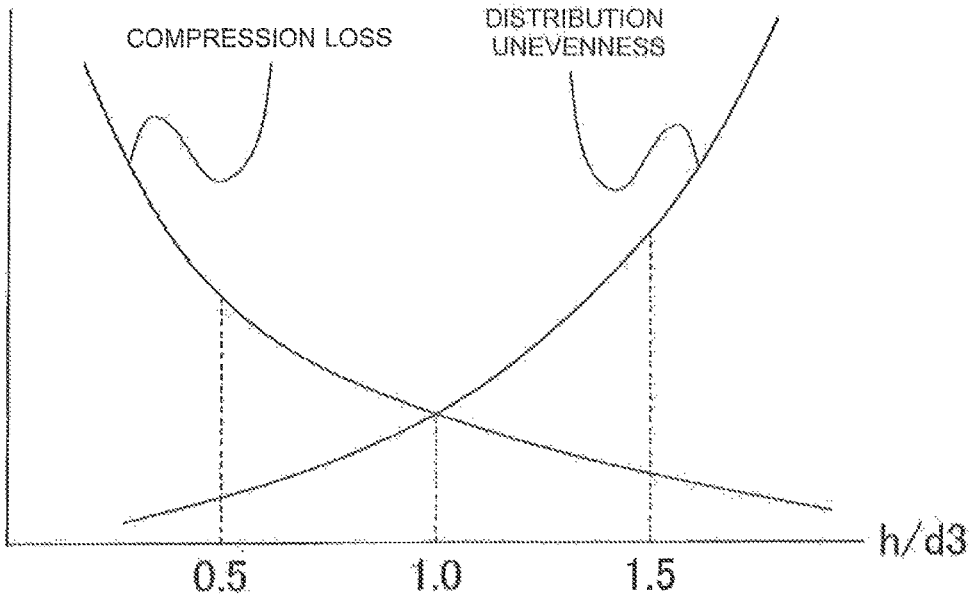
FIG. 10 is a graph showing compression loss and distribution unevenness in the distributor 5 according to Embodiment 6 of the present invention.

FIG. 10 is a graph showing compression loss and distribution unevenness in the distributor 5 according to Embodiment 6 of the present invention. The horizontal axis of the graph represents the ratio of the width h of the distribution path 102 in the flow direction to the inner diameter d3 of the capillary tube 6 (h/d3). The vertical axis of the graph represents magnitude of the compression loss and the distribution unevenness. The pressure loss in Embodiment 6 refers to pressure loss suffered between the outlet of the introduction pipe 51 and the inlet opening of the tapered path 103*a*, in other words the pressure loss suffered in the distribution path 102. The distribution unevenness in Embodiment 6 refers to a difference between a maximum value and a minimum value of the flow rate of the refrigerant flowing through each of the capillary tubes 6.

When the width h of the distribution path 102 in the flow direction is small, the volume of the distribution path 102 is also small, and hence flow loss of the refrigerant is increased. The increase in flow loss makes the opening degree of the expansion valve 21 insufficient, which disturbs the operation of the air-conditioning apparatus 1. Therefore, it is preferable to increase the width h of the distribution path 102 in the flow direction. However, when the width h of the distribution path 102 in the flow direction is excessively increased, the two-phase refrigerant which has flowed in through the introduction pipe 51 and collide the opposing wall surface is dispersed in the distribution path 102, and the liquid-phase components which have been scattered are coupled again owing to surface tension. The recoupling of the liquid-phase components makes the liquid-phase refrigerant uneven in the distribution path 102, thereby increasing the distribution unevenness.

In Embodiment 6, setting the ratio of the width h of the distribution path 102 in the flow direction to the inner diameter d3 of the capillary tube 6 to be higher than 0.5 and lower than 1.5 allows the two-phase refrigerant to be evenly distributed to the capillary tubes 6, while suppressing an increase in pressure loss. In Embodiment 6, therefore, the two-phase refrigerant can be evenly distributed to each path of the outdoor heat exchanger 22 (evaporator), and consequently the expected performance of the outdoor heat exchanger 22 (evaporator) can be secured.

Embodiment 7

Figure 11:
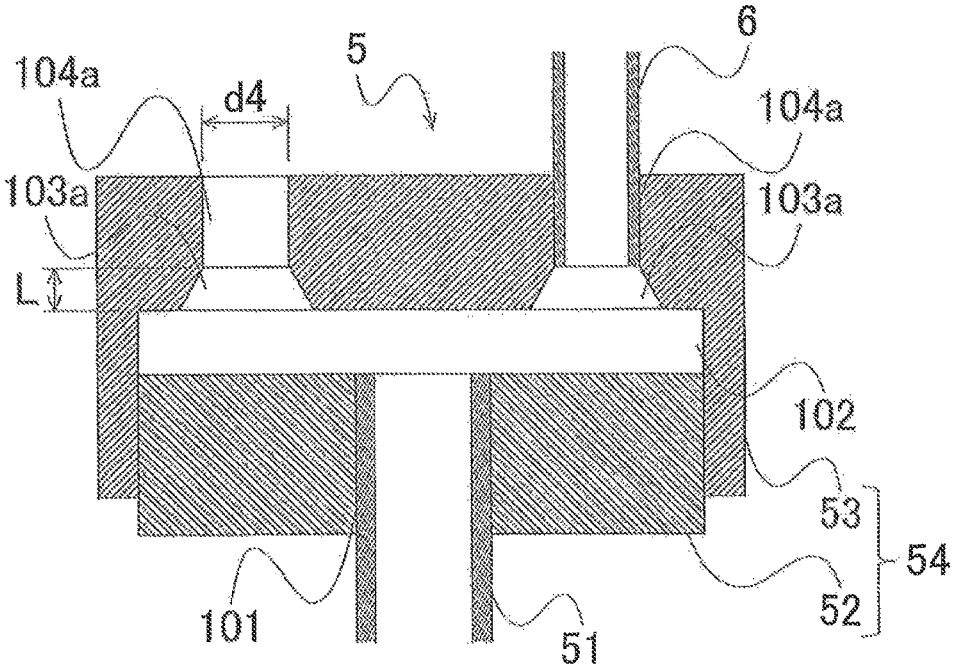
FIG. 11 is a schematic cross-sectional view showing the distributor 5 according to Embodiment 7 of the present invention.

FIG. 11 is a schematic cross-sectional view showing the distributor 5 according to Embodiment 7 of the present invention. In FIG. 11, the introduction pipe 51 is connected to the refrigerant inflow path 101 of the first member 52, and the capillary tubes 6 are respectively connected to the refrigerant outflow paths 104*a* of the second member 53. In addition, dimension lines are included in FIG. 11. FIG. 11 represents the same configuration as FIG. 3*c*, except for the presence of the dimension lines.

Since the components of Embodiment 7 are the same as those in Embodiment 1, the description will not be repeated. In the distributor 5 according to Embodiment 7, a width L of the tapered path 103*a* in the flow direction is set so as not to exceed twice a diameter d4 of the outlet opening of the tapered path 103*a*, to suppress an increase in dimensions of the distributor 5.

Other Embodiments

The present invention is not limited to foregoing Embodiments, but may be modified in various manners. For example, although the description of Embodiments is based on the assumption that the air-conditioning apparatus 1 is performing the heating operation, the distributor 5 according to Embodiments provides the same advantageous effects also in the cooling operation of the air-conditioning apparatus 1. In the cooling operation, since the indoor heat exchanger 31 acts as evaporator the distributor 5 is located in the indoor unit 3, and connected between the expansion valve 21 and the indoor heat exchanger 31.

The distributor 5 according to Embodiments may be employed in any other desired refrigeration cycle apparatus that includes the refrigeration cycle 4, without limitation to the air-conditioning apparatus 1.

In addition, although the outer shape of the second member 53 according to Embodiments is cylindrical, different shapes may be adopted. The outer shape of the second member 53 may be modified as desired so as to fit the actual location of the distributor 5. For example, the outer shape of the second member 53 may be cubic.

Further, although the main body 54 according to Embodiments is composed of two members, the main body 54 may be constituted of a single member, or three or more members.

Further, the distribution path 102 according to Embodiments is formed in a cylindrical shape, different shapes may be adopted. For example, the distribution path 102 may be formed so as to have a polygonal cross-section, such as a rectangular block-shaped flow path.

Still further, although the second member 53 according to Embodiments includes four each of the tapered paths 103*a*, 103*b*, and 103*c*, and the refrigerant outflow paths 104*a* and 104*b*, a different number of paths may be provided. The number of paths may be increased or decreased depending on the number of paths in the outdoor heat exchanger 22 (or indoor heat exchanger 31) acting as evaporator.

Still further, although the refrigerant outflow path 104*b* according to Embodiment 4 includes the stepped portion, the upper edge of which has a diameter the same as the outer diameter of the capillary tube 6, the refrigerant outflow path 104*b* may be formed in different shapes. For example, the refrigerant outflow path 104*b* may be formed in a cylindrical shape without the stepped portion, so as to make the diameter thereof the same as the outer diameter of the capillary tube 6.

The invention claimed is:

1. A distributor comprising:
a main body including:
a refrigerant inflow path;
a plurality of refrigerant outflow paths;
a distribution path communicating with the refrigerant inflow path and the plurality of refrigerant outflow paths; and
a plurality of tapered paths each communicating between corresponding one of the plurality of refrigerant outflow paths and the distribution path,
the plurality of tapered paths each having an inlet opening and an outlet opening, the inlet opening being larger than the outlet opening,
wherein
a capillary tube is connected to each of the refrigerant outflow paths, and the capillary tube has an inner diameter same as a diameter of the outlet opening of an corresponding one of the tapered paths,
a ratio of the inner diameter the capillary tube to a width of the distribution path in the flow direction is higher than 0.5 and lower than 1.5.

2. The distributor of claim 1,
wherein the main body includes a first member and a second member connecting to the first member,
the refrigerant inflow path is formed in the first member,
the distribution path is formed by coupling the first member and the second member with each other, and
the plurality of refrigerant outflow paths and the plurality of tapered paths are formed in the second member.

3. The distributor of claim 1,
wherein each of the tapered paths has a truncated conical shape.

4. The distributor of claim 3,
wherein an angle between a generatrix of the flow path having the truncated conical shape and a flow direction is equal to or more than 30 degrees and equal to or less than 60 degrees.

5. The distributor of claim 1,
wherein a side face of each of the tapered paths is formed such that a cross-sectional shape taken along the flow path direction is a quadrant shape.

6. The distributor of claim 1,
wherein the refrigerant inflow path is formed so as to allow refrigerant to evenly flow into the plurality of tapered paths through the distribution path.

7. A refrigeration cycle apparatus comprising:
a compressor;
a condenser;
an expansion valve;
the distributor of claim 1; and
an evaporator.

8. A distributor comprising:
a main body including:
a refrigerant inflow path;
a plurality of refrigerant outflow paths;
a distribution path communicating with the refrigerant inflow path and the plurality of refrigerant outflow paths; and
a plurality of tapered paths each communicating between corresponding one of the plurality of refrigerant outflow paths and the distribution path,
the plurality of tapered paths each having an inlet opening and an outlet opening, the inlet opening being larger than the outlet opening, wherein
a width of each of the tapered paths in the flow direction is equal to or smaller than twice the diameter of the outlet opening of the corresponding one of the tapered paths.

9. The distributor of claim 8,
wherein the main body includes a first member and a second member connecting to the first member,
the refrigerant inflow path is formed in the first member,
the distribution path is formed by coupling the first member and the second member with each other, and
the plurality of refrigerant outflow paths and the plurality of tapered paths are formed in the second member.

10. The distributor of claim 8,
wherein each of the tapered paths has a truncated conical shape.

11. The distributor of claim 10,
wherein an angle between a generatrix of the flow path having the truncated conical shape and a flow direction is equal to or more than 30 degrees and equal to or less than 60 degrees.

12. The distributor of claim 8,
wherein a side face of each of the tapered paths is formed such that a cross-sectional shape taken along the flow path direction is a quadrant shape.

13. The distributor of claim 8,
wherein a capillary tube is connected to each of the refrigerant outflow paths, and the capillary tube has an inner diameter same as a diameter of the outlet opening of an corresponding one of the tapered paths.

14. The distributor of claim 8,
wherein the refrigerant inflow path is formed so as to allow refrigerant to evenly flow into the plurality of tapered paths through the distribution path.

15. A refrigeration cycle apparatus comprising:
a compressor;
a condenser;
an expansion valve;
the distributor of claim 8; and
an evaporator.

* * * * *